US006796237B2

(12) United States Patent
Schuster et al.

(10) Patent No.: US 6,796,237 B2
(45) Date of Patent: Sep. 28, 2004

(54) METHOD FOR IMAGING AND ERASING AN ERASABLE PRINTING FORM

(75) Inventors: Alfons Schuster, Augsburg (DE); Michael Schönert, Augsburg (DE); Alfred Hirt, München (DE); Robert Weiss, Gersthofen (DE)

(73) Assignee: MAN Roland Druckmaschinen AG, Offenback am Main (DE)

( * ) Notice: Subject to any disclaimer, the term of this patent is extended or adjusted under 35 U.S.C. 154(b) by 0 days.

(21) Appl. No.: 09/041,416

(22) Filed: Mar. 12, 1998

(65) Prior Publication Data

US 2003/0089260 A1 May 15, 2003

Related U.S. Application Data

(62) Division of application No. 08/786,750, filed on Jan. 24, 1997, now abandoned.

(30) Foreign Application Priority Data

Jan. 24, 1996 (DE) ..... 196 02 328

(51) Int. Cl.[7] ..... B41N 1/14; G03G 13/28
(52) U.S. Cl. ..... 101/467; 101/478; 430/49
(58) Field of Search ..... 101/456, 457, 101/463.1, 465, 466, 467, 478; 430/49

(56) References Cited

U.S. PATENT DOCUMENTS

| | | | | | |
|---|---|---|---|---|---|
| 3,607,255 | A | * | 9/1971 | Back | 101/463.1 |
| 3,650,797 | A | * | 3/1972 | Tomanek | 101/463.1 |
| 3,921,527 | A | * | 11/1975 | Raschke et al. | 101/463.1 |
| 4,020,762 | A | * | 5/1977 | Peterson | 101/467 |
| 4,103,616 | A | * | 8/1978 | Chu et al. | 101/467 |
| 4,204,865 | A | * | 5/1980 | Kuehnle et al. | 101/463.1 |
| 4,705,696 | A | * | 11/1987 | Calabrese et al. | 101/459 |
| 5,067,404 | A | * | 11/1991 | Frunder et al. | 101/467 |
| 5,213,041 | A | * | 5/1993 | Kanck | 101/467 |
| 5,317,970 | A | * | 6/1994 | Nussel et al. | 101/467 |
| 5,462,833 | A | * | 10/1995 | Hauquier et al. | 101/457 |

FOREIGN PATENT DOCUMENTS

| | | |
|---|---|---|
| CA | 2 154 012 | 1/1996 |
| DE | 37 13 801 | 11/1988 |
| EP | 0 099 264 | 1/1984 |
| EP | 101 266 | 2/1984 |
| EP | 520 332 | 12/1992 |
| EP | 0 580 394 | 1/1994 |
| JP | 51-113629 | 10/1976 |
| JP | 3-13392 | 1/1991 |
| JP | 4-42264 | 2/1992 |
| JP | 4-97848 | 3/1992 |
| JP | 4-134457 | 5/1992 |
| JP | 4-247472 | 9/1992 |
| JP | 5-185575 | 7/1993 |
| JP | 5-229090 | 9/1993 |
| JP | 7-76063 | 3/1995 |
| JP | 07-290682 | 11/1995 |

OTHER PUBLICATIONS

Article entitled "Neue Technologien zur filmlosenHerstellung von Druckformen" by Von Hansjörg W. Vollmann taken from Angew. Chem. 92, 95–106 (1980), pp 95–106.
"Technologie des Offsetdrucks", Riedl et al.; VEB Fachbuchverlag Leipaig; p. 105–111; 1989.

* cited by examiner

*Primary Examiner*—Stephen R. Funk
(74) *Attorney, Agent, or Firm*—Cohen, Pontani, Lieberman & Pavane

(57) ABSTRACT

A method for imaging a printing form in which the printing form is charged on its entire surface and is coated on its entire surface with particles, in particular toner particles, which bear the opposite charge. The layer formed by the particles is then fixed in accordance with the image by a beam, in particular a laser beam, and especially by infrared radiation, on the surface of the printing form or ablated in accordance with the image. Thereupon, the unfixed portions of the layer are removed or the non-ablated portions are fixed by full-surface heat treatment.

22 Claims, 1 Drawing Sheet

METHOD FOR IMAGING AND ERASING AN ERASABLE PRINTING FORM

This is a divisional application of parent application Ser. No. 08/786,750 filed Jan. 24, 1997, now abandoned.

BACKGROUND OF THE INVENTION

1. Field of the Invention

The present invention relates to a method of imaging and erasing an erasable printing form.

2. Description of the Prior Art

From the textbook, "Technologie des Offset-Druck" {Technology of Offset Printing] by R. Riedl, D. Neumann, J. Teubner, (Leipzig), 1989 (1st Edition), it is already known to charge an aluminum printing plate, which bears a photosemi-conductive layer on its surface, electrically as a whole and then expose it in accordance with a picture which is to be printed. At the exposed places of the printing form, the charges flow off while they remain on the non-exposed places. Charged dry or liquid toner particles of opposite electrical charge are then applied by a roller. The toner particles are applied only to the non-exposed places of the printing form. The toner particles which have been applied are then fixed by heat.

European reference EP 0 099 264 A2 discloses a method for illustrating a printing form with dry toner particles. Here, the surface of a substrate is covered in its entirety with electrostatically charged dry toner particles whereupon these particles are melted by laser light in the picture regions so that they adhere firmly to the substrate.

EP 0 580 394 A2 discloses a method for the imaging of a lithographic plate by applation, in which portions of a plastic layer corresponding to a picture to be printed are removed by laser radiation.

SUMMARY OF THE INVENTION

The object of the present invention is to provide a method for imaging and erasing an erasable printing form.

Pursuant to this object, and others which will become apparent hereafter, one aspect of the present invention resides in a method of imaging and erasing an erasable printing form, which includes the steps of electrically charging the printing form on its entire surface so that liquid toner particles, which have either individual charges opposite the charges of the printing form or dipole or multi-dipole moments directed opposite the charges of the printing form, are attracted over their entire surface by the printing form; fixing the liquid toner particles with a source of energy in accordance with a picture to be printed; one of removing and breaking down non-fixed liquid toner particles in a manner which changes ink acceptance behavior; and erasing the printing form as a whole, after an end of a printing process, by removing the fixed liquid toner particles.

One particular advantage of the printing form of the present invention is that it can be erased. The fact that the printing form can be illustrated in a printing press is also advantageous. The printing form is preferably developed as a sleeve without a clamping channel on the form cylinder. An electric potential can be applied to the form cylinder so that toner can be applied to the printing form, as in electrophotographic methods.

A further object of the invention is to provide an erasable printing form that can be used in the inventive method.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
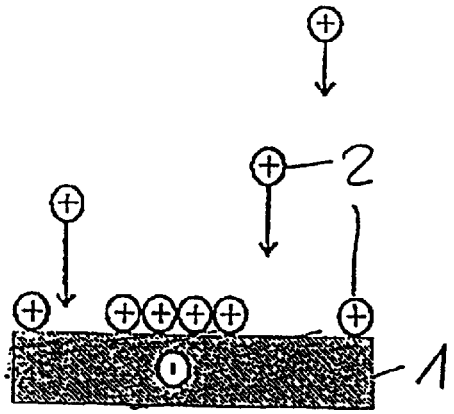
FIG. 1 shows the attraction of charged toner particles to a charged printing form.

The printing form 1 (FIG. 1) is illustrated by charged particles 2. The printing form 1 consists either of a conductive material or of a dielectric, electrically chargeable material. It is either a foil, for instance of a plastic such as polyester, a metal, for instance aluminum, a ceramic, or a glass. Suitable materials are known from German reference DE 44 26 012 A1. Alloys, in particular nickel-chrome-steels, nickel-chrome-iron alloys or nickel-chrome-molybdenum alloys are also suitable. The surface of the printing form 1 is preferably hydrophilic or hydrophilizable. If the printing form 1 consists of an electrically conductive material, then, during the application of the particles, a potential, which is opposite the charges thereof or the charge distributions which are active in the direction towards the surface of the printing form, is applied to the printing form while the particles 2 are applied. The particles 2 are attracted by the coulomb force. If the surface of the printing form 1 consists of an electrically non-conductive material, then an electrically conductive layer must be present below the layer in order to charge the surface layer by a source of voltage, for instance by corona electrodes.

The particles 2 are preferably toner particles. The toner particles 2 either have color pigments or are unpigmented. The particles 2 also preferably have a diameter of less than 1 $\mu$m. By the electrostatic attraction between the surface of the printing form 1 and the particles 2, a very thin uniform layer can be produced. Image information is then applied by means of energy-rich magnetic radiation, in particular laser radiation, corresponding to an image which is to be printed by the printing form. A laser beam 3 (FIG. 2) is conducted in the region of the image over a layer 4 formed by the particles 2 on the printing form 1. In this way, the particles 2 are cross-linked in the layer 4, whereby the adherence to the surface of the printing form is increased as compared with the unirradiated regions on the printing form. The particles 2 in the unirradiated region are then completely removed from the surface of the printing form by mechanical treatment, electrically, or by ultrasonics, for instance by means of an ultrasonic basin. The image thus produced can, in addition, be further treated in order again to increase the fixing of the layer 4 on the surface of the printing form 1.

The wavelength of the beams used for this, for instance infrared or ultraviolet, depends on the maximum absorption of the material of the layer 4, i.e. of the particles 2. It also depends on the reflection of absorption of the corresponding radiation by the printing form 1 lying below the layer 4. Particularly when the particles 2 themselves do not absorb radiation in the infrared region, it is advantageous for the printing form 1 to contain, at least in its surface, a material, for instance carbon, which absorbs the infrared radiation, or for it to have a black color. Pigmented toner particles, for instance toner particles which contain carbon black or graphite, are also particularly suitable in order to absorb infrared radiation. However, particles 2 which absorb ultraviolet radiation are also suitable if, by the absorption of this radiation, electrical bonding of the particles 2 for the cross-linking and further fixing of the picture regions of the layer 4 are favored. The strength and time of action of the radiation as well as the wavelength thereof therefore depend on the material of the particles 2, the material of which the printing form 1 consists, as well as the combination of materials of the particles 2 and the printing form 1.

After the illustrating, the surface of the printing form 1 can be subjected on the non-picture regions, i.e. on the regions in which the layer 4 has not been removed, can be subjected on the non-picture regions for a positive image or on the picture regions for a negative image, i.e. on the regions the layer 4 has been removed to a further treatment, for instance a hydrophilizing so that it takes on a moistening agent, insofar as a moistening agent is used in the printing process, as in the case, for instance, of wet offset printing. The hydrophilizing of the surface of the printing form 1 can however, also take place before the application of the particles 2 to the entire surface, should this be necessary. After completion of the printing process, the surface of the printing form 1 must be restored again. First of all, printing ink which has remained on the layer 4 and the free regions of the printing form 1 must be removed whereupon the particles 2 in the layer 4 are removed. For this purpose, a solvent, for instance acetone, is applied by means of brushes, nozzles, or a cloth and then removed, together with the traces of the layer 4, by brushing or an absorptive cloth. Ultrasonic treatment is also suitable for the removal of the picture regions of the layer 4.

The thickness of the layer 4 is preferably 1 $\mu$m or less. However, it can also be far thinner, for instance only 0.1 $\mu$m thick. The particles 2 need not necessarily bear a charge of their own. Other suitable materials are materials the particles of which have dipole, quadripole or other multipole moments which align themselves in the electric field so that they are attracted by an electrically charged surface such as the surface of the printing form 1. The particles 2 are in particular toner particles, the toner being a solid or liquid toner. Both toners having a water base and ones having an oil base can be used. The toner can be both pigmented (transparent) or non-pigmented. If the toner is non-pigmented, then, if the particles are to be cross-linked by heat radiation on the surface of the printing form 1, the surface of the printing form 1 itself must absorb the infrared radiation. In this way the particles 2 are indirectly heated so that their cross-linking with each other takes place proceeding from the surface of the printing form 1. Similarly, the adherence of the particles 2 to the printing form 1 is favored by this infrared radiation.

Instead of a single toner material, particles of different charge density (Q/m) (Q=charge; m=mass) can be used so that upon the illustrating of the printing form 1 (see FIG. 1), those particles which have the highest charge density are attracted first so that they lie lowermost in the layer 4, while those particles 2 which have the smallest charge density are attracted last, so that they lie on top in the layer 4. Such differences in charge density of the particles 2 can be utilized in order to form the layer 4 from a plurality of sub-layers, which can then be utilized for the printing process, for instance for color differentiation.

Figure 3:
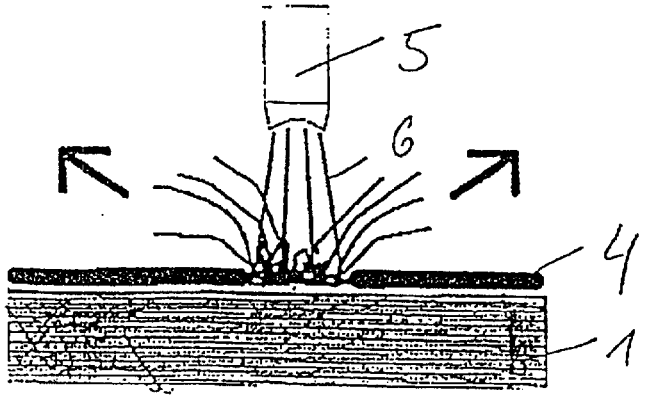
FIG. 3 shows the removal of toner particles from the surface of the printing form.

For removing particles 2 which have not been cross-linked by the beam 3 from the surface of the printing form 1, methods in which the particles are removed by vacuum are also suitable. The particles can also be removed by electrophoresis, in which case an electric potential is applied to a body which is brought into the vicinity of the printing form—the body is for instance a roll—which potential is greater than the potential of the printing form 1. This means that when the printing form 1 is at a negative potential, the roll 1 must have an even stronger negative potential in order to attract the particles 2 which in this case are positively charged or have an electric multipole moment which acts positively towards the outside from the printing form 1. Means which contact the surface of the printing form 1 mechanically are also suitable, for instance brushes, or liquids which are applied preferably under pressure, for instance by high pressure, onto the surface of the printing form 1 in order to detach the non-cross-linked particles 2 from the surface thereof. For this purpose (FIG. 3) a jet of liquid 6 is applied by a nozzle 5 onto the surface of the printing form, which dissolves the layer 4 in the non-cross-linked regions.

The differentiation of the color absorption behavior of the layer 4 applied in accordance with FIG. 1 can also be obtained in the manner that the layer 4 is removed (ablated) or at least broken down by laser radiation corresponding to the printed picture to be produced so that it has a different acceptance behavior for a printing ink or a moistening agent. Thereupon the remaining toner particles 2 of the layer 4 are cross-linked by heat treatment, in particular by electromagnetic radiation, on the surface of the printing form 1. This means that the removal step (see FIG. 3) is eliminated in this case.

Figure 2:
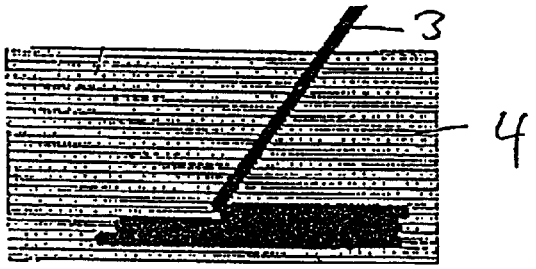
FIG. 2 shows the fixing of toner particles by means of a laser beam.

If the fixing of the particles 2 in the layer 4 on the printing form 1, which has been described with reference to FIG. 2, is already sufficiently strong, it is not necessary again to fix the particles 2 remaining on the printing form after the treatment step and after the removal of unneeded particles 2 by heat or radiation. If the radiation by the laser beam, however, has led only to a partial cross-inking of the particles 2 in the picture regions, they—after the particles 2 have been removed from the non-picture regions—can be fixed on the printing form 1, by a full-surface treatment of the surface of the printing form 1, including the picture portions of the layer 4 remaining on it, by heat and particularly by infrared radiation or hot air, so that they remain attached for the duration of a printing run.

If, however, such an after treatment by heat is not necessary, the unirradiated and thus non-cross-linked particles 2 need not be removed from the surface of the printing form 1 since the cleaning in a cleaning step which precedes the printing process or, if there is no such cleaning step, then the first revolutions of the printing unit already cause these particles 2 to be given off to the printing material.

The high-energy radiation for the fixing of the particles 2 on the surface of the printing form 1 (see FIG. 2) can also be obtained by incoherent light sources, for instance a mercury-vapor lamp. For the removal of particles 2 from the surface of the printing form 1, solvents, for instance n-methylpyrrolidone, acid or alkaline aqueous solutions, cleansing agents which act mechanically on the surface of the printing form, or the application of water or a jet of solvent under high pressure, particularly at high temperature, are also suitable. High-energy radiation is also suitable for removing non-cross-linked particles 2 from the surface of the printing form 1. In such case, the radiation, however, must be directed only at those regions where the particles 2 have not been previously (or simultaneously) cross-linked by the beam 3.

As compared with other methods for the illustrating of a printing form, the method of the invention has the advantage that the printing form can be produced within the printing press itself. In particular, a sleeve-shaped printing form can also be used. Such a sleeve-shaped printing form can be replaced by removing it from the sidewall of a printing unit of the printing press, particularly if the surface of the printing form no longer has the desired surface roughness. Similarly, a printing foil can be used which can be applied for instance by winding on the form cylinder, as known from Federal Republic of Germany 43 04 872 C2. Due to the fact that the layer 4 is very thin, only a very small amount of material is consumed. The thickness of the layer 4 can be controlled and simply reproduced upon the electrostatic charging by the variation of voltage and/or time. A small, flexibly constructed, easily replaceable illustrating unit can be used. Additionally, toner particles or other particles 2 having different chemical and physical properties can be used. Conventional printing forms which are based on an aluminum layer or some other metal can also be used in order to illustrate them in accordance with the invention. The illustrating process can also be carried out outside the printing press.

In accordance with the invention, a method for illustrating a printing form 1 is created in which the printing form 1 is charged on its entire surface and coated on its entire surface with particles 2, in particular toner particles, which bear the opposite charge. Thereupon, the layer 4 formed by the particles 2 is fixed in accordance with the image by a beam 3, in particular a laser beam, especially by infrared radiation, or ablated in accordance with the image. Thereupon the unfixed portions of the layer 4 are removed or the non-ablated portions are fixed by full-surface heat treatment.

The invention is not limited by the embodiments described above which are presented as examples only but can be modified in various ways within the scope of protection defined by the appended patent claims.

We claim:

1. A method of imaging and erasing an erasable printing form, comprising the steps of:

electrically charging the printing form over its entire surface, the printing form being a sleeve-shaped printing form;

applying liquid toner particles, which have one of individual charges opposite the charges of the printing form, and dipole and multi-pole moments aligned opposite the charges of the printing form, to the printing form so that the toner particles are attracted to the entire surface of the printing form to form a layer;

controlling the thickness of the layer of liquid toner particles by controlling at least one of voltage and time during the charging step;

fixing the liquid toner particles with a source of energy in accordance with a picture to be printed, and one of removing and breaking down non-fixed liquid toner particles to change ink acceptance behavior of the layer;

using the printing form in a printing process; and erasing the printing form as a whole, after an end of the printing process, by removing the fixed liquid toner particles using one of a solvent, an acid or alkaline aqueous solution, a mechanical force, a high temperature, energy bearing radiation, and ultrasound.

2. A method according to claim 1, including, for imaging, fixing the liquid toner particles on image locations of the printing form and, in corresponding manner, removing the liquid toner particles from non-image locations.

3. A method according to claim 1, wherein the charging step includes charging a printing form having a conductive surface.

4. A method according to claim 3, wherein the charging step includes charging a metal printing form.

5. A method according to claim 1, wherein the charging step includes charging a printing form that has a dielectric on its surface.

6. A method according to claim 5, including charging the dielectric surface of the printing form by corona charging.

7. A method according to claim 1, wherein the fixing step includes fixing a layer of the liquid toner particles applied to the surface of the printing form with a beam of electromagnetic waves.

8. A method according to claim 7, wherein the fixing step includes fixing the liquid toner particles with a laser beam.

9. A method according to claim 7, wherein the fixing step includes fixing the liquid toner particles with a beam in the infrared region.

10. A method according to claim 7, and further comprising the step of additionally fixing portions of the layer which have remained on the surface of the printing form by full-surface treatment with radiation.

11. A method according to claim 10, wherein the additional fixing step includes fixing the portions of the layer which have remained on the surface of the printing form with heat radiation.

12. A method according to claim 1, including providing one of the liquid toner particles and the printing form with an absorber material for absorbing the energy.

13. A method according to claim 1, wherein the removing step includes removing the liquid toner particles which are not fixed on the surface of the printing form by one of a mechanical force, a solvent which is applied under pressure, absorption, an electric field, and ultrasonics.

14. A method according to claim 1, and further comprising the step of hydrophilizing regions of the printing form which are not covered by the liquid toner particles for wet offset printing.

15. A method according to claim 1, wherein the fixing step includes fixing the liquid toner particles using a focused non-coherent light source for cross-linking the liquid toner particles on the surface of the printing form.

16. A method according to claim 15, wherein the fixing is carried out using a mercury-vapor lamp.

17. A method according to claim 1, wherein the removing step includes ablating the liquid toner particles from the surface of the printing form using a focused and non-coherent light source.

18. A method according to claim 1, wherein the erasing step includes removing the remaining layer of fixed particles with an organic solvent.

19. A method according to claim 1, wherein the erasing step includes removing the remaining layer of fixed particles with one of an acid and an alkaline aqueous solution under high pressure, so that the particles are dissolved.

20. A method according to claim 1, wherein the erasing step includes removing the remaining of the layer of fixed particles with one of a brush and a cleaning cloth.

21. A method according to claim 1, including, for imaging, fixing the liquid toner particles on non-image locations of the printing form and, in a corresponding manner, removing the liquid toner particles from image locations.

22. The method according to claim 1, wherein the printing form is arranged without a clamping channel on a form cylinder within a printing press for at least said steps of charging the printing form, applying liquid toner particles, and fixing the liquid toner particles.

* * * * *